US008777821B2

(12) United States Patent
Lando et al.

(10) Patent No.: US 8,777,821 B2
(45) Date of Patent: Jul. 15, 2014

(54) EXERCISE DEVICE HAVING ADJUSTABLE RESISTANCE FORCE

(76) Inventors: Paul F Lando, Red Lion, PA (US); Kent D Russell, Harrisburg, PA (US); Donald C Early, Craley, PA (US)

( * ) Notice: Subject to any disclaimer, the term of this patent is extended or adjusted under 35 U.S.C. 154(b) by 369 days.

(21) Appl. No.: 13/192,134

(22) Filed: Jul. 27, 2011

(65) Prior Publication Data

US 2013/0029811 A1 Jan. 31, 2013

(51) Int. Cl.

| | |
|---|---|
| ***A63B 23/14*** | (2006.01) |
| ***A63B 23/16*** | (2006.01) |
| ***A63B 21/02*** | (2006.01) |
| ***A63B 21/045*** | (2006.01) |

(52) U.S. Cl.
USPC ..... 482/121; 482/44; 482/45; 482/46; 482/49; 482/92; 482/122; 482/126; 482/127

(58) Field of Classification Search
CPC ..... A63B 21/023; A63B 21/1469; A63B 21/00069; A63B 21/045; A63B 21/00043; A63B 21/026; A63B 21/05; A63B 21/1434; A63B 23/14; A63B 23/16
USPC ..... 482/44–50, 121–130, 92
See application file for complete search history.

(56) References Cited

U.S. PATENT DOCUMENTS

| | | | | |
|---|---|---|---|---|
| 3,330,558 | A * | 7/1967 | Simons, Jr. | 482/46 |
| 3,717,338 | A | 2/1973 | Hughes | |
| 4,304,402 | A | 12/1981 | Ripp | |
| 4,618,142 | A | 10/1986 | Joseph | |
| 4,623,141 | A | 11/1986 | Salvino | |
| 4,643,417 | A * | 2/1987 | Nieman | 482/46 |
| 4,651,985 | A * | 3/1987 | Salisbury | 482/122 |
| 4,695,049 | A * | 9/1987 | Ciemiega | 482/46 |
| 4,852,873 | A | 8/1989 | O'Donnell | |
| 4,856,776 | A * | 8/1989 | Ching-Liang | 482/122 |
| 4,869,491 | A | 9/1989 | Nolan | |
| 4,901,999 | A | 2/1990 | Schott | |
| 5,046,727 | A * | 9/1991 | Wilkinson et al. | 482/45 |
| 5,244,442 | A | 9/1993 | Schill | |
| 5,514,055 | A * | 5/1996 | Elliott | 482/92 |
| 5,547,441 | A | 8/1996 | Mora | |
| 5,613,928 | A | 3/1997 | Laudone | |
| 5,620,398 | A | 4/1997 | Moriarty | |
| 5,776,034 | A | 7/1998 | Stamler | |
| 5,868,651 | A | 2/1999 | Washington | |
| 5,921,902 | A | 7/1999 | Carpenter | |
| 6,024,679 | A | 2/2000 | Castallanos | |
| 6,129,650 | A | 10/2000 | Wedge | |
| 6,217,495 | B1 | 4/2001 | Yalch | |
| 6,312,359 | B1 | 11/2001 | Brundle | |
| 6,945,918 | B1 | 9/2005 | Hill | |

(Continued)

*Primary Examiner* — Loan H Thanh
*Assistant Examiner* — Joshua Lee
(74) *Attorney, Agent, or Firm* — Picadio Sneath Miller & Norton, P.C.; Robert L. Wagner

(57) ABSTRACT

An exercise device for exercising hand, wrist, arm, and upper body muscles having adjustable force resistance and a force setting indicator. The exercise device includes a housing, a first handle connected to one end of the housing, a second handle connected to the opposite end of the housing, an inner spring disposed inside the housing, and an outer spring disposed inside the housing. The outer spring is connected to the inner spring and encases the inner spring. An adjuster knob disposed on the second handle and coupled to the inner spring and configured to adjust a tension of the inner spring and compression of the outer spring.

3 Claims, 3 Drawing Sheets

(56) References Cited

U.S. PATENT DOCUMENTS

| | | | | |
|---|---|---|---|---|
| 7,056,268 | B2 | 6/2006 | Emick | |
| 7,351,186 | B1 | 4/2008 | Herman | |
| 7,837,598 | B1 | 11/2010 | Boozel | |
| 2004/0033867 | A1 | 2/2004 | Katami | |
| 2008/0051271 | A1* | 2/2008 | Mandell | 482/122 |
| 2010/0179037 | A1 | 7/2010 | Reilly | |
| 2010/0204026 | A1 | 8/2010 | Watson | |

* cited by examiner

EXERCISE DEVICE HAVING ADJUSTABLE RESISTANCE FORCE

BACKGROUND OF THE INVENTION

The present invention generally relates to an exercise device. More particularly, the present invention relates to an exercise device having adjustable resistance force.

Several strength and rehabilitation training exercises require the user to work the wrists, hands, arms and upper body muscles. Current exercise devices have proven successful in strengthening one of the muscles. However, some known exercise devices are not particularly efficient in strengthening together the hand, wrist, arms and upper body muscles. In addition, current exercise devices for strengthening these muscles may be limited to one force of resistance that depends on the target muscle. In view of this, the user is required to have a separate exercise device to exercise the muscles of the wrist, hand, arms and upper body. Unfortunately, requiring different exercise devices requires additional space and investment.

As can be seen, there is a need for providing an exercise device that may allow the user to strengthen different muscles of the upper extremities at the same time, over a range of resistive forces, using one piece of equipment in multiple planes of movement.

SUMMARY OF THE INVENTION

In one aspect of the present invention, an exercise device includes a housing, a first handle connected to one end of the housing, a second handle connected to the opposite end of the housing, an inner spring disposed inside the housing, and an outer spring disposed inside the housing, the outer spring connected to the inner spring and encases the inner spring, and an adjuster knob disposed on the second handle and coupled to the inner spring and configured to adjust a tension of the inner spring and compression of the outer spring.

In another aspect of the present invention, an exercise device includes a housing, the housing encases an inner spring sleeve, an inner spring disposed inside the inner spring sleeve, and an outer spring connected to the inner spring, the outer spring encasing the inner spring sleeve, a first handle connected to one end of the housing, a second handle connected to the opposite end of the housing, an adjuster knob including a threaded rod having one end connected to a spring mounted nut, the spring mounted nut coupled to the inner spring, the threaded rod moves the spring mounted nut adjusting a tensile force on the inner spring.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is mace merely for the purpose of illustrating the general principles of the invention, since the scope of the invention is best defined by the appended claims.

Various inventive features are described below that can each be used independently of one another or in combination with other features.

Broadly, embodiments of the present invention generally provide an exercise device for hand, wrist, arm, and upper body muscles at the same time over a range of resistive forces using one piece of equipment in multiple planes of movement. In addition, the present invention provides an exercise device that adjusts the force of resistance including a force indicator.

Figure 1:
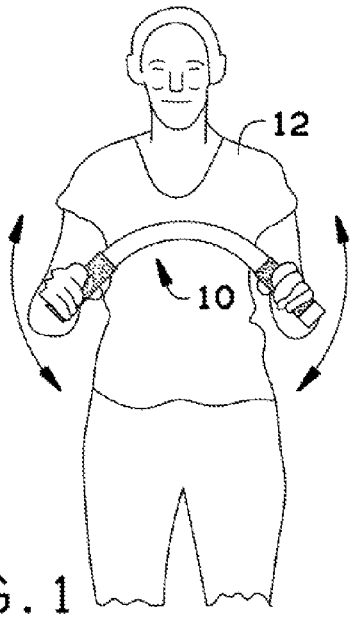
FIG. 1 illustrates a front view of an exercise device having an adjustable resistance force according to an exemplary embodiment of the present invention showing the exercise device in use.
Figure 2:
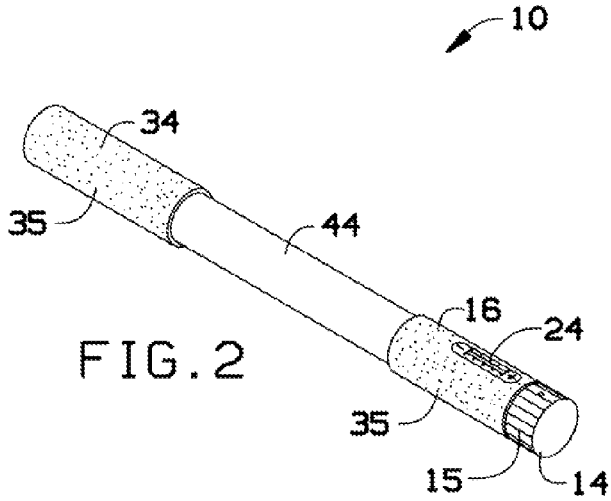
FIG. 2 illustrates a perspective front view of the exercise device of FIG. 1.
Figure 3:
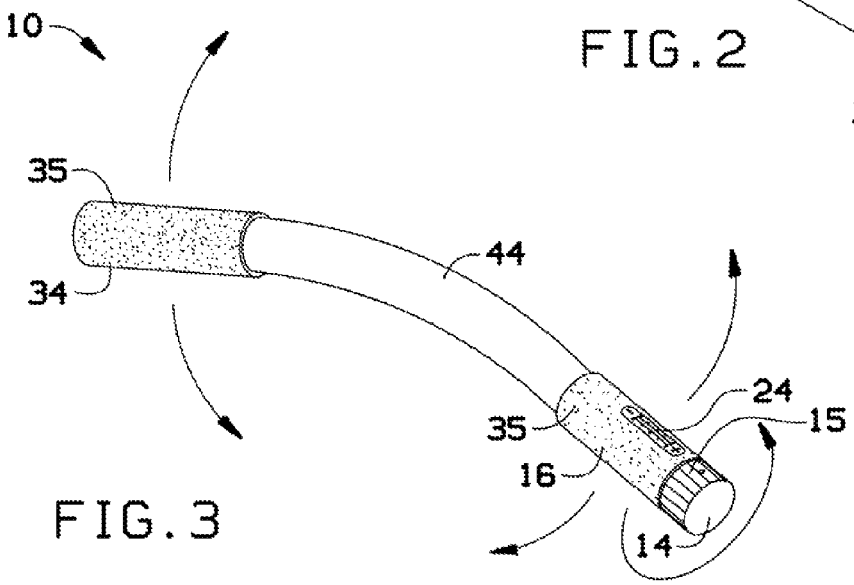
FIG. 3 illustrates a perspective front view of the exercise device of FIG. 2 showing the exercise device in flexion and rotation of an adjustable knob.
Figure 4:
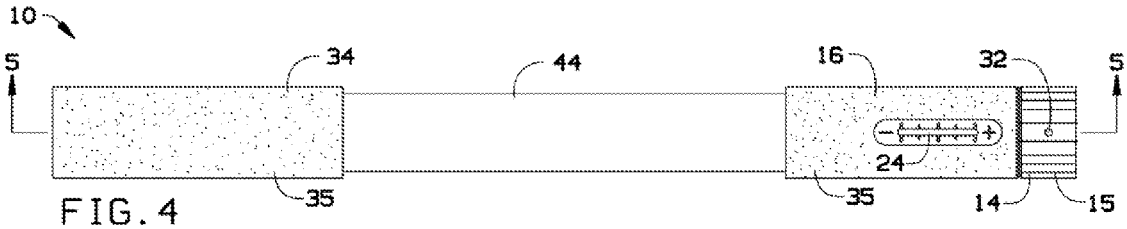
FIG. 4 illustrates a top view of the exercise device of FIG. 2.
Figure 5:
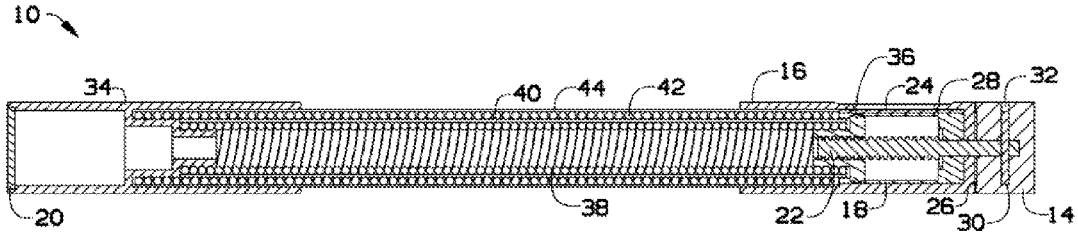
FIG. 5 illustrates a cross-sectional view of the exercise device taken along line 5-5 in FIG. 4.
Figure 6:
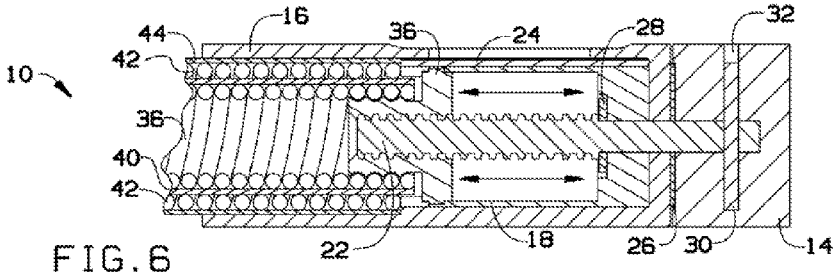
FIG. 6 illustrates a detailed view of a horizontal translation of a spring mounted nut for the exercise device of FIG. 2.
Figure 7:
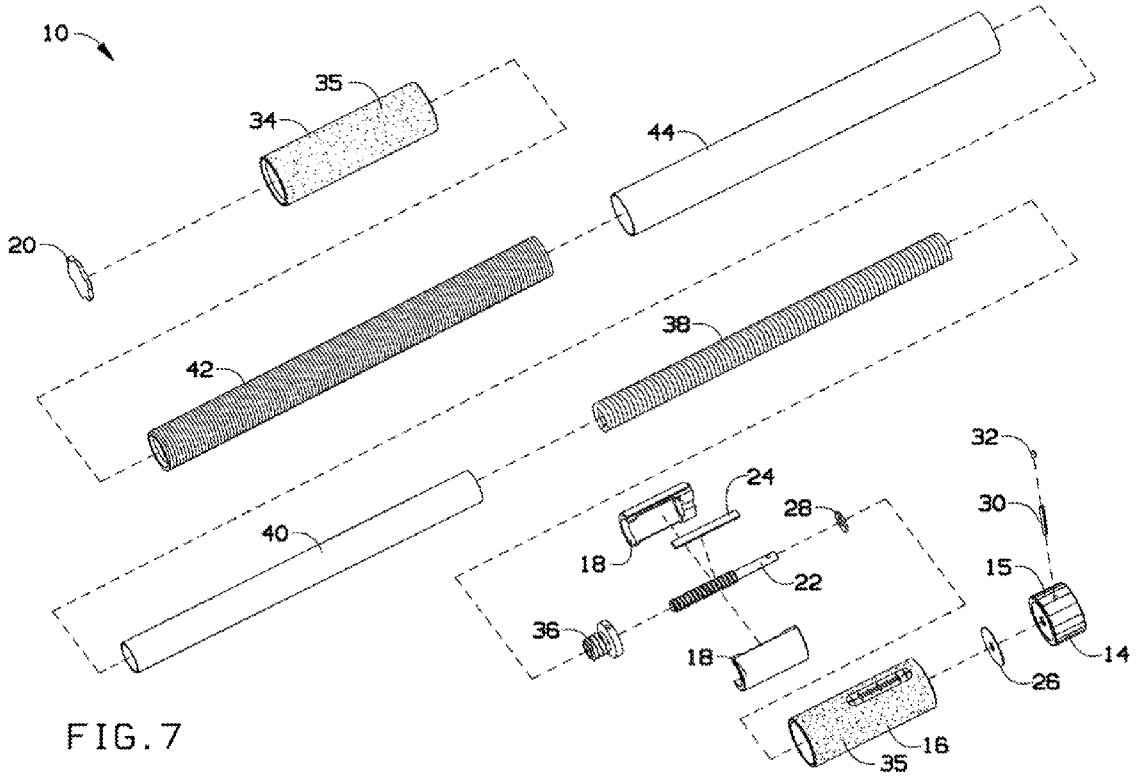
FIG. 7 illustrates an exploded view of the exercise device of FIG. 2.

FIG. 1 illustrates an exercise device 10 according to an exemplary embodiment of the present invention. A user 12 may use the exercise device 10 to strengthen, for example, his/hers hand, wrist, arm, and upper body muscles at the same time over a range of resistive forces.

As can be seen in FIGS. 2-7, the exercise device 10 may include a housing 44, a first handle 34 connected to one end of the housing 44, a second handle 16 connected to the opposite end of the housing 44, and an adjuster knob 14 connected to the second handle 16. The housing 44 may enclose an inner spring sleeve 40, an inner spring 38 inside the inner spring sleeve 40, and an outer spring 42. The inner spring sleeve 40 may be made of a noise suppressant material. The inner spring sleeve 40 may be made of latex, rubber, silicon, or foam. The inner spring 38 may fit snuggly in the inner spring sleeve 40. The inner spring 38 may be made of material that stretches under applied tensile forces and returns to original length when the tensile force is removed. The inner spring 38 may be made of steel using left or right wound coil construction. The outer spring 42 may be made of a material that may bend and rotate under tensional loading, while maintaining column height under compressive loads. The winding direction of the outer spring may be opposite to the winding direction of the inner spring 38.

The housing 44 may be to cover the outer spring 42. The housing 44 may be a hollow tubing. The housing 44 may be made of latex, rubber, silicon, cloth or foam. The housing 44 may provide pinch protection. The housing 44 may provide noise and vibration reduction. The housing 44 may include ornamental decorations or advertisements. The ornament decorations may be figures and/or logos. The housing 44 may have a geometrical shape. The shape of the housing 44 may conform to the outer spring 42. The housing 44 may be 1.5 inches in diameter and the same length as the outer spring 42.

The first handle 34 may allow the user 12 to grasp one end of the exercise device 10. The first handle 34 may be a hollow handle. The first handle 34 may be made of sturdy material. The first handle 34 may be made of plastic, resin, metal, wood, composite material, or polymer. The size and shape of the first handle 34 may depend on the size and shape of the housing 44.

The second handle 16 may allow the user 12 to grasp the opposite end of the exercise device 10. The second handle 16 may be made of the same material as the first handle 34. The size and shape of the second handle 16 may depend on the size and shape of the housing 44.

A handgrip material 35 may be fit onto the outer periphery of the first handle 34 and/or the second handle 16 to provide a comfortable grip. The handgrip material 35 may be made of a material that provides cushioning and wear resistance, including cushioned tape, leather, rubber, vinyl, or foam. The grip material 35 may be either friction fit over the handles 34, 16 or bonded thereto by means of any suitable adhesive. The handgrip material 35 may be a machined or molded surface texture in the first handle 34 and/or the second handle 16.

The adjuster knob 14 may allow the user 12 to adjust a bending force of the exercise device 10. In addition, the adjuster knob 14 may provide the exercise device 10 with an additional gripping surface. The adjuster knob 14 may be made of the same material as the first handle 34. The adjuster knob 14 may include notches 15 for easy operation. The adjuster knob 14 may have a machined or molded surface texture for easy operation.

A window 24 may be located on the second handle 16. The window 24 may be made of transparent material. The window 24 may be made of transparent acrylic, transparent rigid plastic or glass. The window 24 may allow the user 12 to check the setting of the resistance force.

The first handle 34 may include an end cap 20 to cover the open end of the first handle. The end cap 34 may be vented. The end cap 20 may be made of the same material of the first handle 34.

The second handle 16 may enclose an indicator sleeve 18 and an adjusting force system 22, 26, 28, 30, 32, 36. The indicator sleeve 18 may provide the bearing surface for the compression of outer spring 42. The indicator sleeve 18 may provide the bearing surface for the threaded adjuster 22 to turn in. The indicator sleeve 18 may provide the bearing surface to react the tensile load on inner spring 38. The indicator sleeve 18 may be made of the same materials of the first handle 34. The indicator sleeve 18 may comprise two identical halves mated together. A threaded adjuster 22 may be encased by the indicator sleeve 18. The threaded adjuster 22 may be a threaded rod made of plastic or metal. The threaded adjuster 22 may allow the inner spring 38 to be moved in the axial direction. A washer 28 may be connected to one end of the threaded adjuster 22. A spring mounted nut 36 may be connected to the opposite end of the threaded adjuster 22. The spring mounted nut 36 may have a central bore for passage of the threaded adjuster 22. The spring mounted nut 36 may be connected to one end of the inner spring 38.

A shim 26 may be operatively connected to the threaded adjuster 22 near the end of the second handle 16. The shim 26 may include a bored hole to allow the passage of the threaded adjuster 22. The shim 26 may provide the adjuster knob 14 with a bearing surface. The shim 26 may be made of a sturdy material. The shim 26 may be made of non-stick material, e.g. Teflon®, plastic, or metal. A spring pin 30 may engage the adjuster knob 14 to the threaded adjuster 22. The spring pin 30 may be made of plastic resin, rigid plastic, wood, or metal.

An end cap 32 may be placed at the end of the second handle 16. The end cap 32 may cover the spring pin.

The user 12 may rotate the adjuster knob 14 to apply a torque through the spring pin 30 and into the threaded adjuster 22. The spring mounted nut 36 may be fixed to the inner spring 38. Thus, when drawn by the threaded adjuster 22, it applies tensile load to the inner spring 38. The inner spring 38 then transmits the force to the outer spring 42 in compression. The inner spring 38 and the outer spring 42 may provide an outwardly resistance force against the inward adjustment of the threaded adjuster 22. The spring mounted nut 36 may have an indicator that can be seen through the window 24 to show force applied to the inner spring 38. By increasing the tension on the inner spring 38, while increasing the compressive force on the outer spring 42, it increases the bending stiffness of the overall exercise device 10 enabling a range of stiffness settings.

The user 12 may grasp the exercise device 10 by the first handle 34 and the second handle 16. The user 12 may bend the exercise device 10 by bending the first handle 34 and the second handle 16. The bending movement exercises, tones and develops arm, hand and wrist and upper body muscles.

It should be understood, of course, that the foregoing relates to exemplary embodiments of the invention and that modifications may be made without departing from the spirit and scope of the invention as set forth in the following claims.

What is claimed is:

1. An exercise device comprising:

a housing, wherein the housing encases an inner spring sleeve, an inner spring disposed inside the inner spring sleeve, and an outer spring connected to the inner spring, the outer spring encasing the inner spring sleeve;

a first handle connected to one end of the housing;

a second handle connected to the opposite end of the housing;

an adjuster knob including a threaded rod having one end connected to a spring mounted nut, the spring mounted nut coupled to the inner spring;

wherein when the threaded rod moves the spring mounted nut adjusting a tensile force on the inner spring.

2. The exercise device according to claim 1, wherein the inner spring is disposed to transmit the tensile force to the outer spring in compression.

3. The exercise device according to claim 1, wherein the adjuster knob is configured to rotate to apply a torque to a threaded adjuster and tension to the inner spring and compression to the outer spring through a spring pin.

* * * * *